US008197304B2

(12) United States Patent
Hummel

(10) Patent No.: US 8,197,304 B2
(45) Date of Patent: Jun. 12, 2012

(54) METHOD AND APPARATUS FOR SHARPENING A TOOL BLADE

(75) Inventor: Richard M. Hummel, Parma, OH (US)

(73) Assignee: Woodpeckers, Inc., North Royalton, OH (US)

( * ) Notice: Subject to any disclaimer, the term of this patent is extended or adjusted under 35 U.S.C. 154(b) by 892 days.

(21) Appl. No.: 12/197,761

(22) Filed: Aug. 25, 2008

(65) Prior Publication Data

US 2009/0088053 A1 Apr. 2, 2009

Related U.S. Application Data

(60) Provisional application No. 60/975,612, filed on Sep. 27, 2007.

(51) Int. Cl.
*B24B 3/38* (2006.01)

(52) U.S. Cl. ..... 451/45; 451/380

(58) Field of Classification Search ..... 451/45, 451/380, 377

See application file for complete search history.

(56) References Cited

U.S. PATENT DOCUMENTS

| | | | | |
|---|---|---|---|---|
| 785,593 | A * | 3/1905 | Craig | 451/321 |
| 1,026,623 | A * | 5/1912 | Caswell | 451/321 |
| 1,979,741 | A * | 11/1934 | Hangi | 451/321 |
| 2,131,626 | A * | 9/1938 | Keith | 451/321 |
| 4,733,501 | A | 3/1988 | McLean | |
| 6,926,596 | B1 | 8/2005 | Tarris | |
| 7,387,562 | B1 * | 6/2008 | Blum | 451/45 |
| 2009/0004956 | A1 * | 1/2009 | Smith | 451/371 |

* cited by examiner

*Primary Examiner* — Robert Rose
(74) *Attorney, Agent, or Firm* — Sand & Sebolt

(57) ABSTRACT

A device for sharpening a tool blade has a pair of spaced guide rails and a bracket for mounting a sharpening stone on the guide rails. A carriage is slidably supported on the guide rails and has a pair of spaced slide plates adjustably supporting a blade angle plate thereon. A clamp mechanism secures the tool blade on the angle plate which is secured in an adjusted position for forming a primary angle on the blade cutting edge by reciprocal movement of the carriage along the guide rails. The angle plate and attached tool blade are readjusted on the carriage for subsequently forming a secondary angle on the cutting edge of the tool blade. Printed indicia adjacent a plurality of adjustment holes formed in the slide plates set the primary and secondary angles of the cutting edge. Mating surfaces on the carriage and guide rails set the amount of material to be removed from the blade during reciprocal movement along an abrasive sharpening material.

18 Claims, 14 Drawing Sheets

METHOD AND APPARATUS FOR SHARPENING A TOOL BLADE

CROSS REFERENCE TO RELATED APPLICATIONS

This application claims priority from U.S. Provisional Application Ser. No. 60/975,612 filed Sep. 27, 2007; the disclosure of which is incorporated herein by reference.

BACKGROUND OF THE INVENTION

1. Technical Field

The invention relates to woodworking tools, and in particular, to an apparatus for sharpening woodworkers' chisels, plane blades, various turning tools, etc. More particularly, the invention relates to an apparatus for use with sharpening stones and honing films for sharpening the beveled edges of a woodworking tool.

2. Background Information

Various devices have been used for sharpening the edges of woodworking tools, such as chisels, plane blades and certain types of turning tools. Many of these tools have a blade with a beveled edge which requires occasional sharpening by removing a certain amount of material from the beveled edge to maintain a sharp edge and the cutting efficiency of the tool. One common method of sharpening tool blades is by manually holding the cutting tool blade and bringing it into sliding contact with a sharpening stone or a honing film depending upon the particular cutting edge and use of the tool.

Various devices have been developed to assist in the sharpening process such as shown in U.S. Pat. No. 6,926,596 which uses a device which holds the tool at a predetermined adjusted angle and then rotates an abrasive surface for sharpening the cutting edge. Another type of tool blade sharpening apparatus is shown in U.S. Pat. No. 4,733,501 wherein the tool blade is clamped at a preset angle on a roller mechanism which is then moved along the abrasive surface. Although these devices, as well as other known sharpening apparatus and methods, have proved satisfactory, it has been found that the manual sharpening of the tool working blade requires skill on part of the user, which is not possessed by many amateur woodworkers, and prior art sharpening apparatus have proved difficult to operate to achieve the desired sharpening.

It is also desirable that the sharpening apparatus be able to accommodate various widths and types of cutting tools without requiring additional components which are subject to loss or misplacement. Furthermore, it is desirable that the sharpening tool can be used with an abrasive surface having a relatively large area, both longitudinally and laterally, to accommodate blades of various widths and avoid always using a very small portion of the abrasive sharpening surface thereby shortening the usefulness of the sharpening stone or honing film.

Furthermore, many of the known prior devices enable the primary angle of the beveled cutting edge to be sharpened, but are difficult to sharpen the smaller secondary angle which is part of many types of cutting edges which, for example, may be 2% off the primary angle.

Therefore, the need exists for an improved method and apparatus for sharpening tool blades which can be used both by a skilled or unskilled woodworker, enabling both primary and secondary angles to be sharpened and formed on the beveled edge of the cutting blade in a simple effective manner without the removal of excess blade material to achieve the sharpened edge.

BRIEF SUMMARY OF THE INVENTION

The present invention provides an apparatus for sharpening a tool blade which is easily used by an amateur woodworker or skilled craftsman to sharpen and form both the primary and secondary angles at the end of the beveled cutting edge of various tool working blades such as chisels, plane blades and various types of turning tools.

Another aspect of the present invention is to provide such a sharpening tool which will sharpen blades having various widths and length without requiring additional components for mounting the blade in the device, and which enables the primary angle to be set with a high degree of accuracy and then after sharpening of the primary angle to easily readjust the apparatus for forming the secondary angle on the sharpened edge in a simple, effective and accurate manner.

A still further feature of the invention is to provide the apparatus with a relatively sturdy construction consisting principally of a support mechanism on which is slidably mounted a carriage having an adjustably mounted angle plate on which the tool blade is securely clamped in an adjusted position, whereupon sliding movement of the carriage along the slide support will automatically sharpen the beveled edge to the desired primary angle which has been preset on the slide mechanism, afterwhich the slide mechanism enables the secondary angle to be set easily for subsequent forming of the secondary angle on the cutting blade without having to reposition or remove the cutting blade from the slide support.

Still another aspect of the present invention is the ability to use either a coarse abrasive stone with the slide carriage, or use the slide carriage with honing films enabling the apparatus to be used for various types of sharpening procedures.

Another feature of the present invention is to provide for the removal of just enough material from the blade edge to provide the desired sharpened edge, thereby avoiding excess removal of blade material thereby increasing the life of the tool blade.

These features and advantages are achieved by the apparatus of the present invention, the general nature of which may be stated as a tool blade sharpening apparatus comprising a pair of guide rails; brackets for mounting a sharpening stone between the guide rails; a carriage movably mounted on the guide rails; a pair of stops limiting movement of the carriage along the guide rails wherein the carriage includes a pair of spaced side plates and an angle plate extending between the side plate; a clamp mechanism mounted on the angle plate for holding the tool blade in contact with the sharpening stone as the carriage moves along the guide rails; and an angle adjustment mechanism for setting the angle of the angle plate and correspondingly the angle of the tool blade with respect to the sharpening stone whereupon linear movement of the carriage along the guide rails moves the blade along the sharpening stone.

These features are further obtained by the method of the present invention for sharpening a cutting edge of tool blades wherein the cutting edge is beveled at a primary angle, the general nature of the method may be stated as comprising the steps of securing a sharpening stone in a support structure, said stone having a substantially planar abrasive surface; mounting the tool blade to be sharpened in a slide mechanism moveably mounted for sliding movement along the support structure; adjusting the angle of the tool blade in the slide mechanism to an angle approximate the primary angle of the cutting edge; clamping the tool blade at the adjusted angle in the slide mechanism; and sliding the slide mechanism along the support structure to move and press the beveled edge of the tool blade into contact with the stationary abrasive surface.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
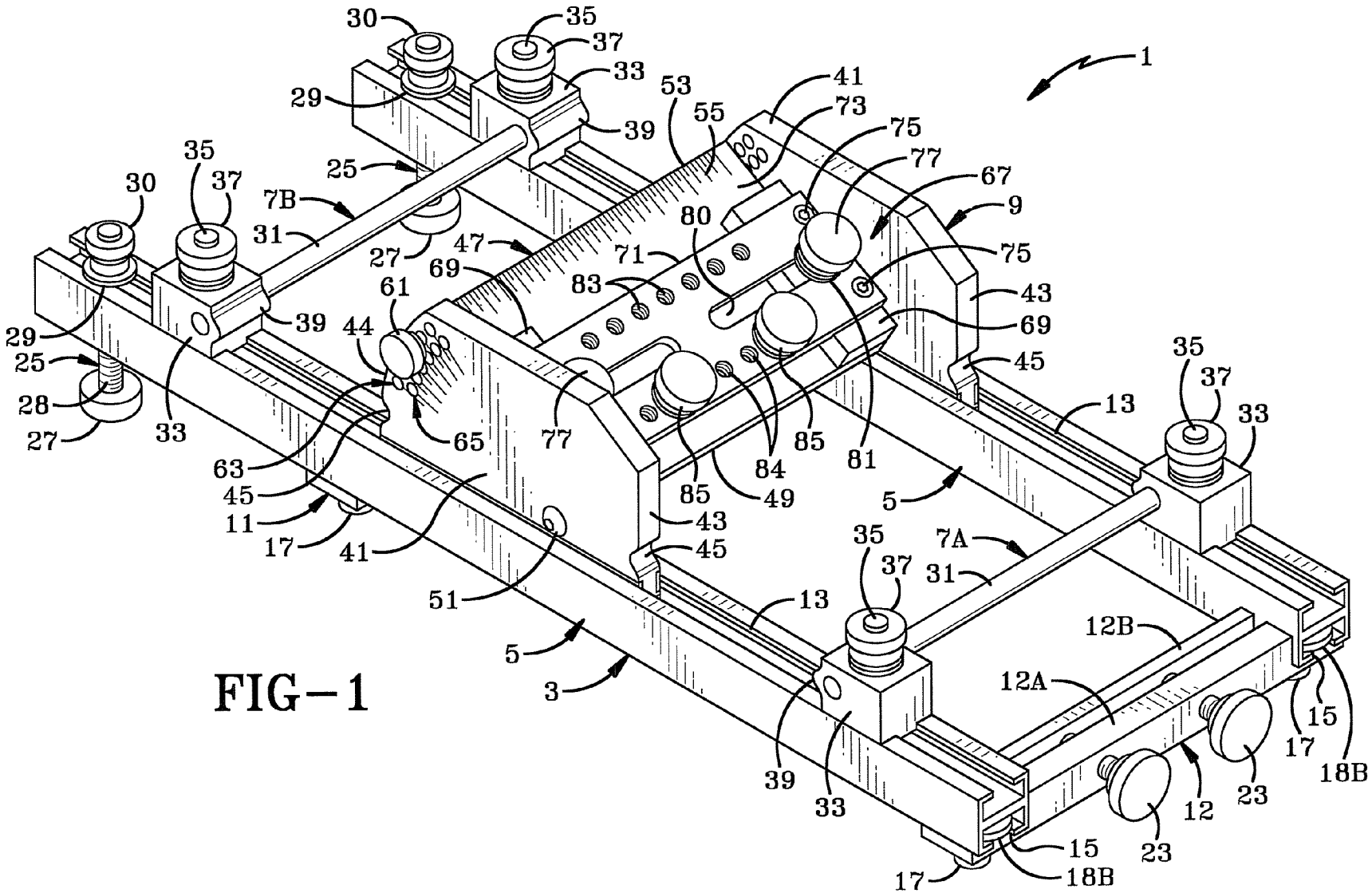
FIG. 1 is a top perspective view of the tool blade sharpening apparatus of the present invention.
Figure 2:
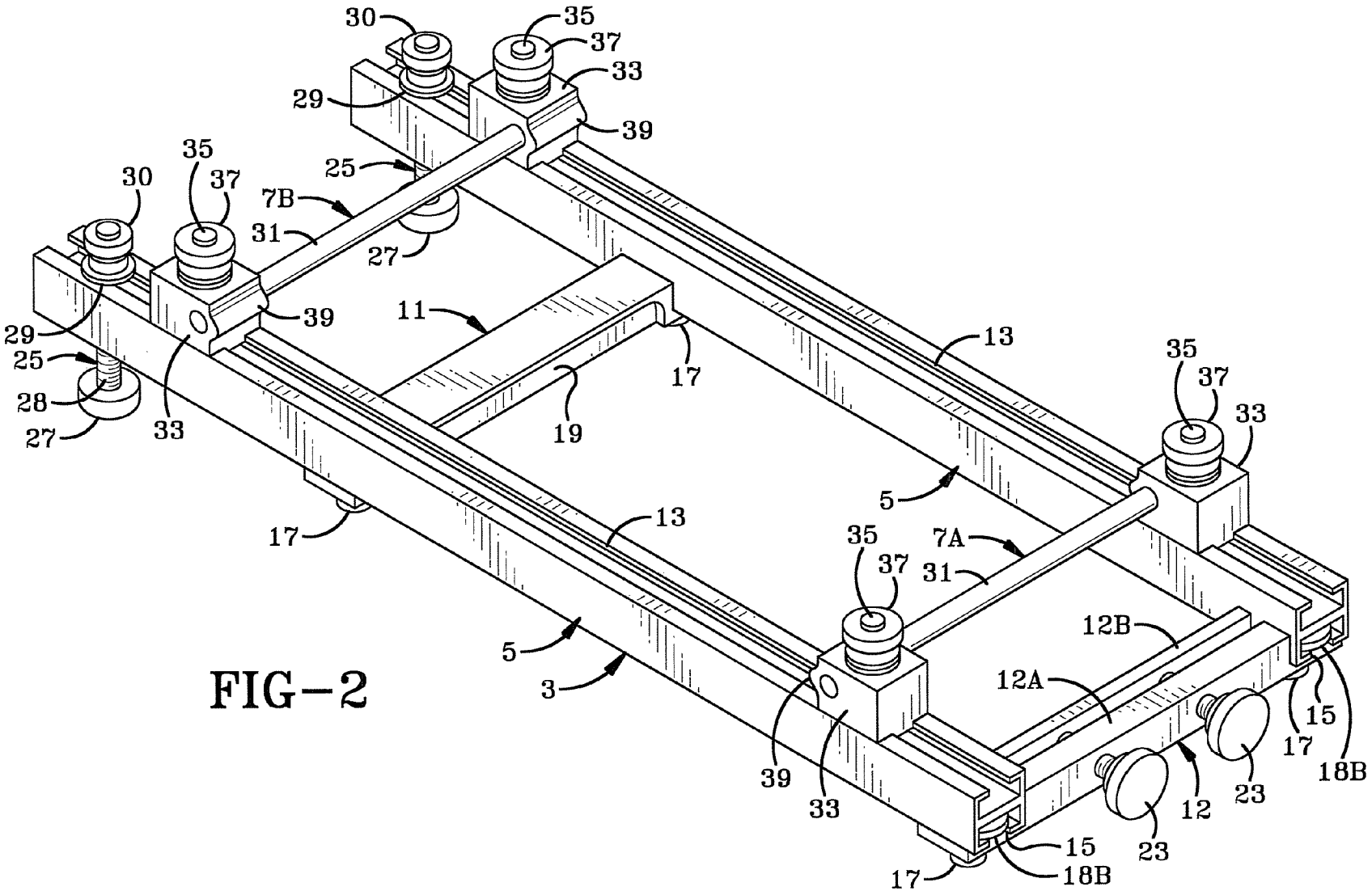
FIG. 2 is a top perspective of the slide support structure component and stop brackets of the blade sharpening apparatus of the present invention.

The apparatus of the present invention for sharpening a tool blade is indicated generally at 1, and is shown in an assembled operative position in FIG. 1. Sharpening apparatus 1 includes as its main components a support structure 3 which includes a pair of slide rails 5, a pair of stop brackets 7A and 7B and a carriage 9. Support structure 3 (FIG. 2) in addition to spaced slide rails 5, includes a pair of sharpening stone mounting brackets 11 and 12 mounted to slide rails 5. Each of the slide rails 5 is formed with a top slide channel 13 and a bottom slide channel 15 which extend throughout the longitudinal length of the slide rails.

Figure 4:
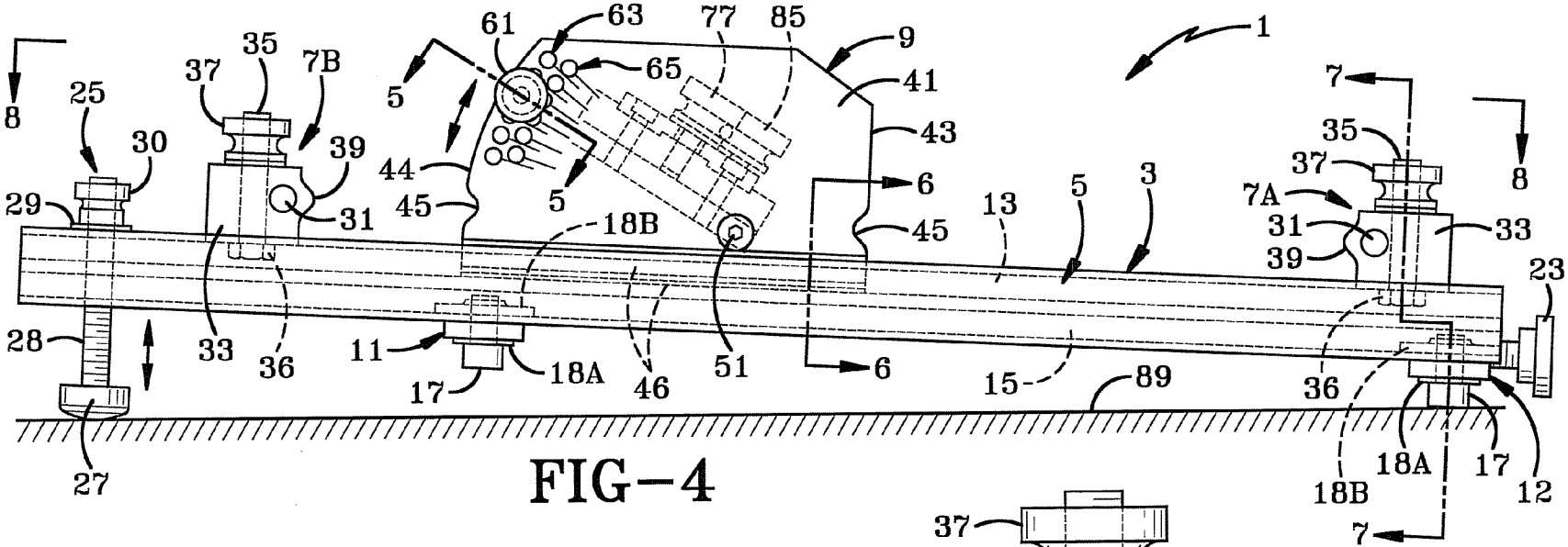
FIG. 4 is a side elevational view of the apparatus of the present invention.
Figure 8:
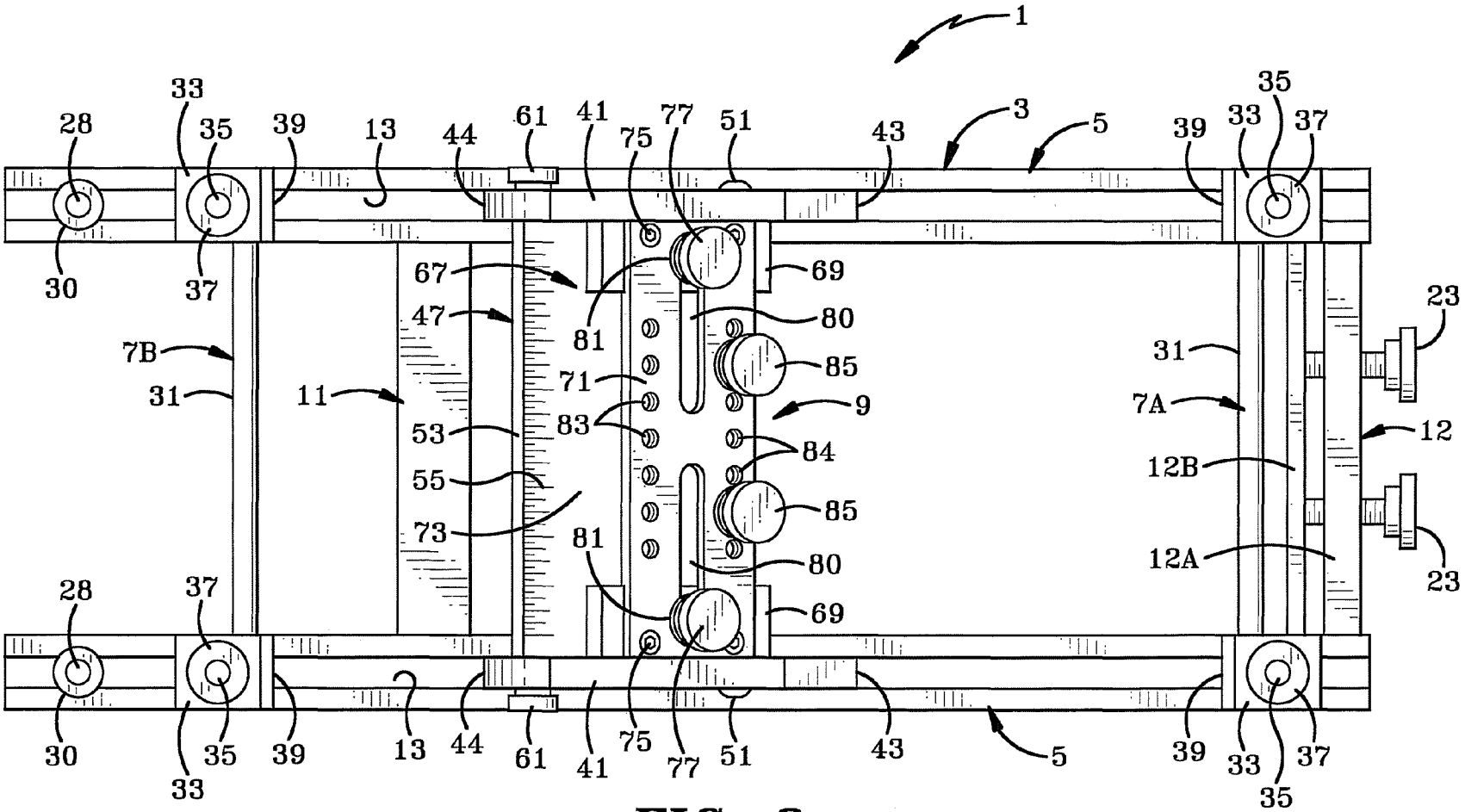
FIG. 8 is a top plan view of the sharpening apparatus of the present invention looking in the direction of Arrows 8-8, FIG. 4.
Figure 11:
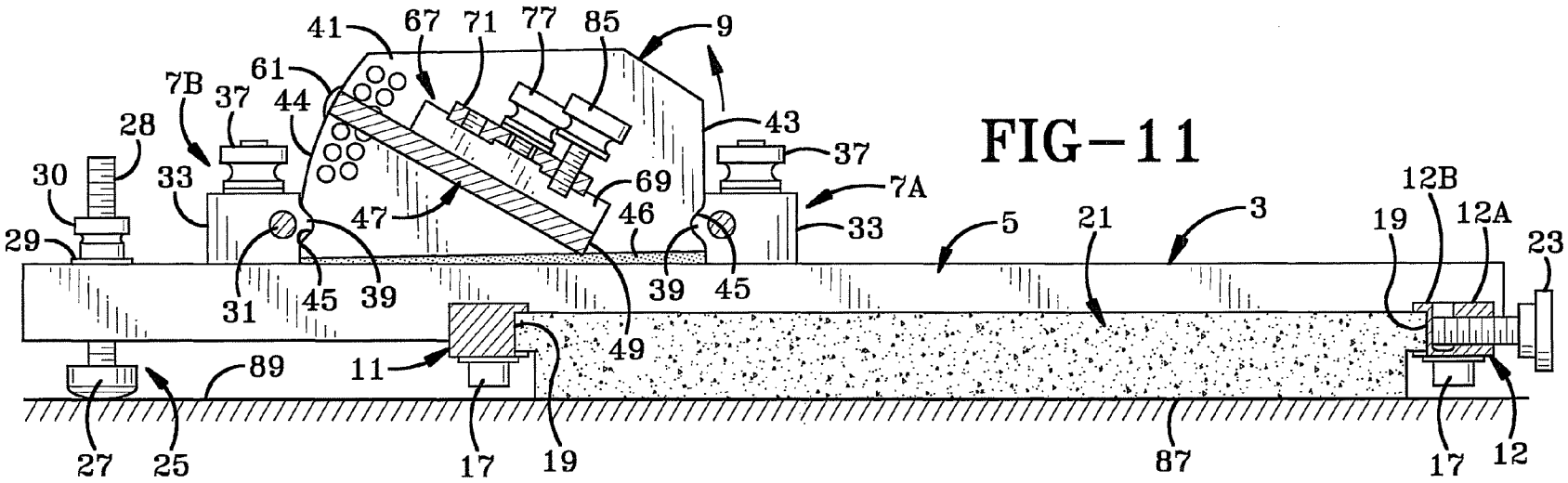
FIG. 11 is a side elevational view of FIG. 10.
Figure 12:
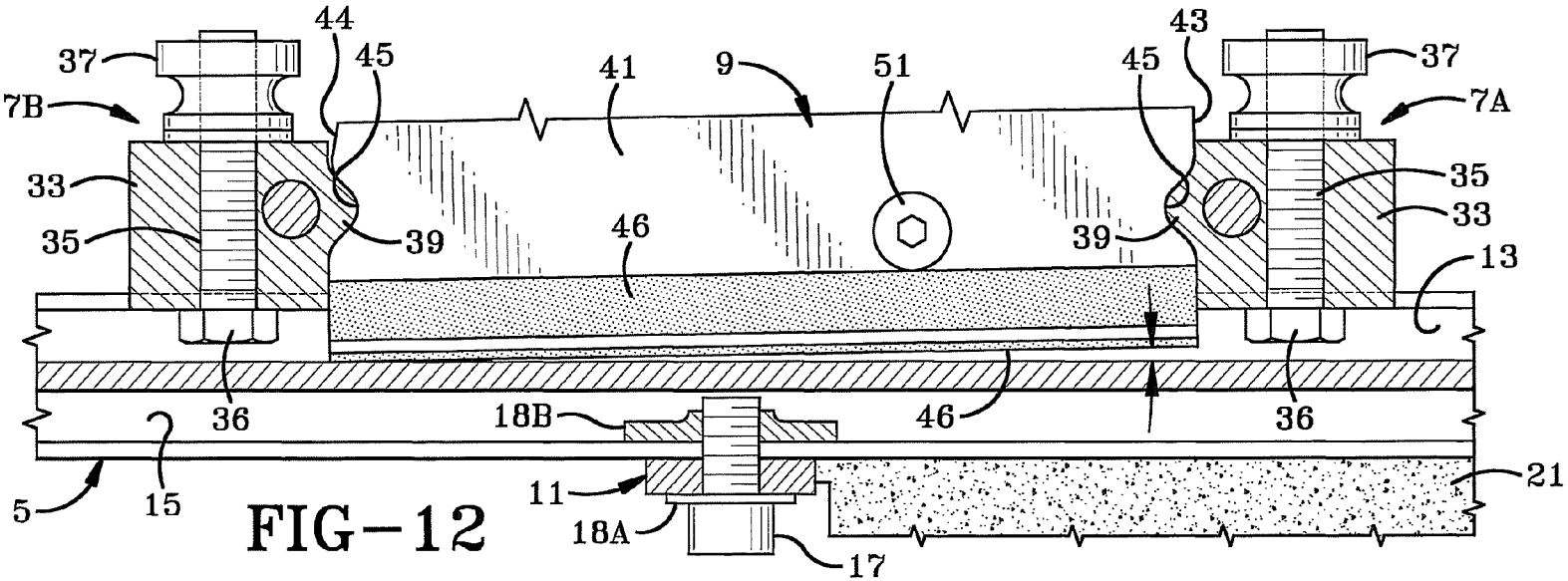
FIG. 12 is an enlarged fragmentary sectional view taken on line 12-12, FIG. 10.

Mounting bracket 11 (FIGS. 2 and 4) includes a pair of cap screws 17 which engage a pair of washers 18A and 18B for slidably mounting and locking bracket 11 in bottom slide channels 15. Thus, bracket 11 is slidably adjustably moved along slide rails 5 and then secured in an adjusted position by tightening screws 17, clamping washer 18B within bottom slide channels 15. Bracket 11 is formed with a cutout 19 (FIG. 2) for receiving and mounting one end of a sharpening stone 21 therein (FIG. 11). Sharpening stone mounting bracket 12 has a similar pair of attachment screws 17 and associated washers 18 and 18A for adjustably securing bracket 12 along slide rails 5 within bottom slide channels 15. Bracket 12 is U-shaped as shown in FIGS. 8 and 11 and includes a pair of tightening screws 23 which extend through threaded holes (not shown) formed in one leg 12A of U-shaped bracket 12 and into contact with spaced leg 12B for clamping sharpening stone 21 or other type of sharpening member between mounting brackets 11 and 12 after being placed therein as shown in FIG. 11. Thus, tightening of screws 23 will flex wall 12B sufficiently to clamp stone 21 between brackets 11 and 12 as shown in FIG. 11.

An adjustment leveler 25 is mounted at the rear end of each slide rail 5. Each leveler includes a support foot 27 mounted on one end of an adjustment screw 28 which has a top clamping washer 29 and a tightening nut 30 mounted at the upper end for securing levelers 25 in an adjusted position on rails 5 as discussed further below.

Figure 7:
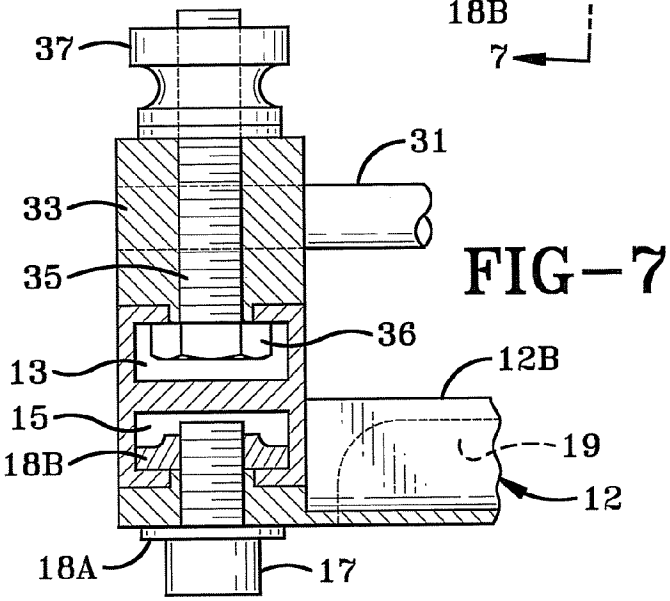
FIG. 7 is an enlarged fragmentary sectional view taken on line 7-7, FIG. 4.
Figure 6:
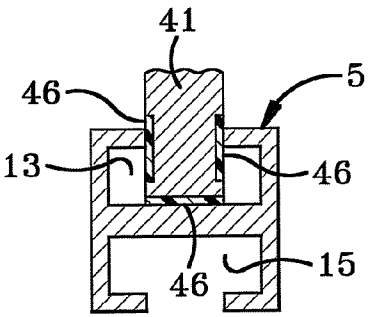
FIG. 6 is an enlarged fragmentary sectional view taken on line 6-6, FIG. 4.

Stop brackets 7A and 7B are similar to each other. Each includes a rod 31 which extends laterally between rails 5 where it is secured in a pair of stop blocks 33 (FIGS. 1 and 7). Each stop block 33 is adjustably slidably mounted within top slide channel 13 by a threaded bolt 35 having a bolt head 36 located within channel 13 and a tightening nut 37. Thus, each stop bracket is slidably adjustably mounted along slide rails 5 and into engagement with carriage 9 as discussed further below. Each slide stop block 33 includes an outwardly projecting curved lobe 39 which extend inwardly toward carriage 9 which is located between the pair of stop brackets, the purpose of which is discussed further below.

Figure 11A:
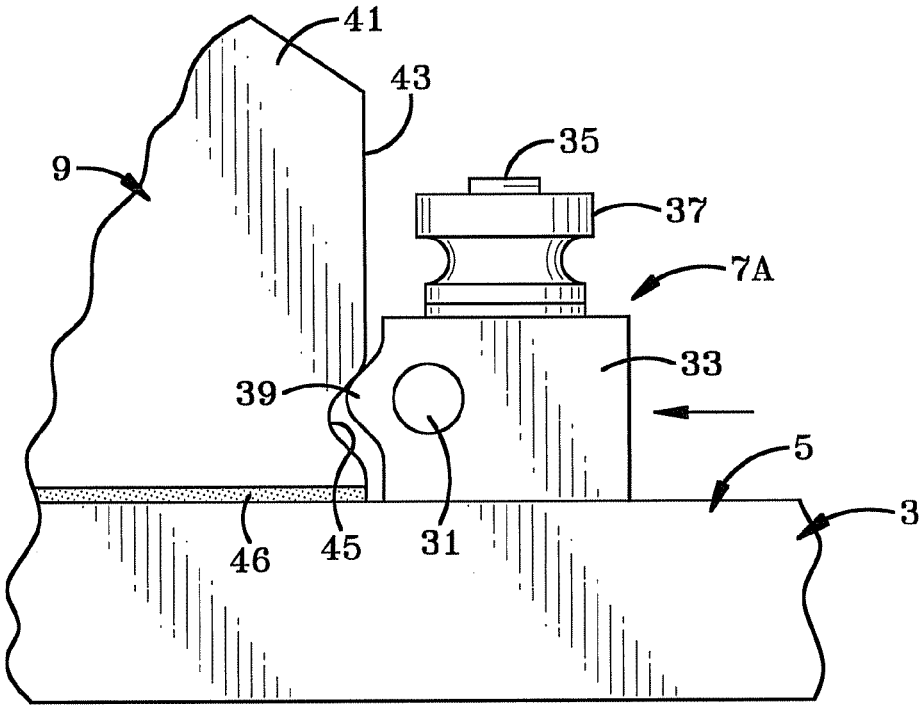
FIG. 11A is an enlarged fragmentary view showing one of the stop bracket lobes being moved into engagement with one of the notches formed in an edge of the slide carriage.
Figure 11B:
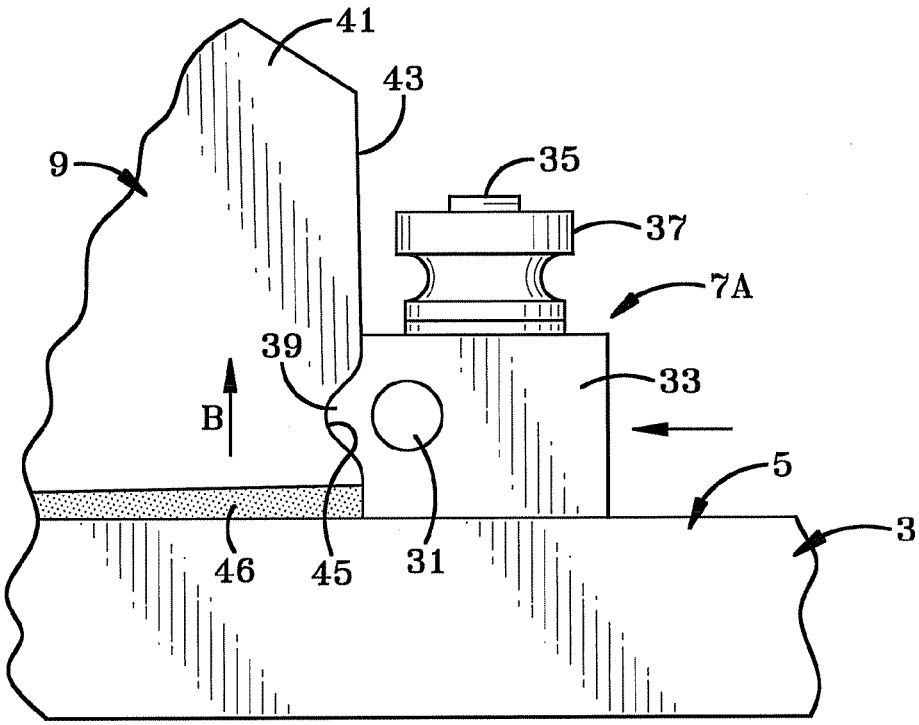
FIG. 11B is a view similar to FIG. 11A showing full engagement of the stop bracket lobe in the carriage notch raising slightly the front edge of the carriage.

Carriage 9 (FIG. 3) includes a pair of side plates 41 which are generally similar to each other, each of which has a front edge 43 and a rear edge 44 in which is formed a V-shaped notch 45 into which stop lobes 39 are adapted to extend as shown particularly in FIGS. 11A and 11B. The lower ends and bottom edge of side plates 41 have spaced strips 46 of a low friction sliding material mounted thereon which engage the inside surfaces of upper slide channel 13 to provide for a smooth sliding engagement therebetween. Carriage 9 includes a generally flat, thin rectangular-shaped angle plate 47 having a lower end 49 which is pivotally mounted by a pair of pivot pins 51 which are mounted in and extend through side plates 41 and into pivotal engagement with plate 47. The upper end 53 of angle plate 47 preferably has measurement indicia 55 embossed or formed therein to assist in centering a tool cutting blade 57, best shown in FIG. 14.

Figure 3:
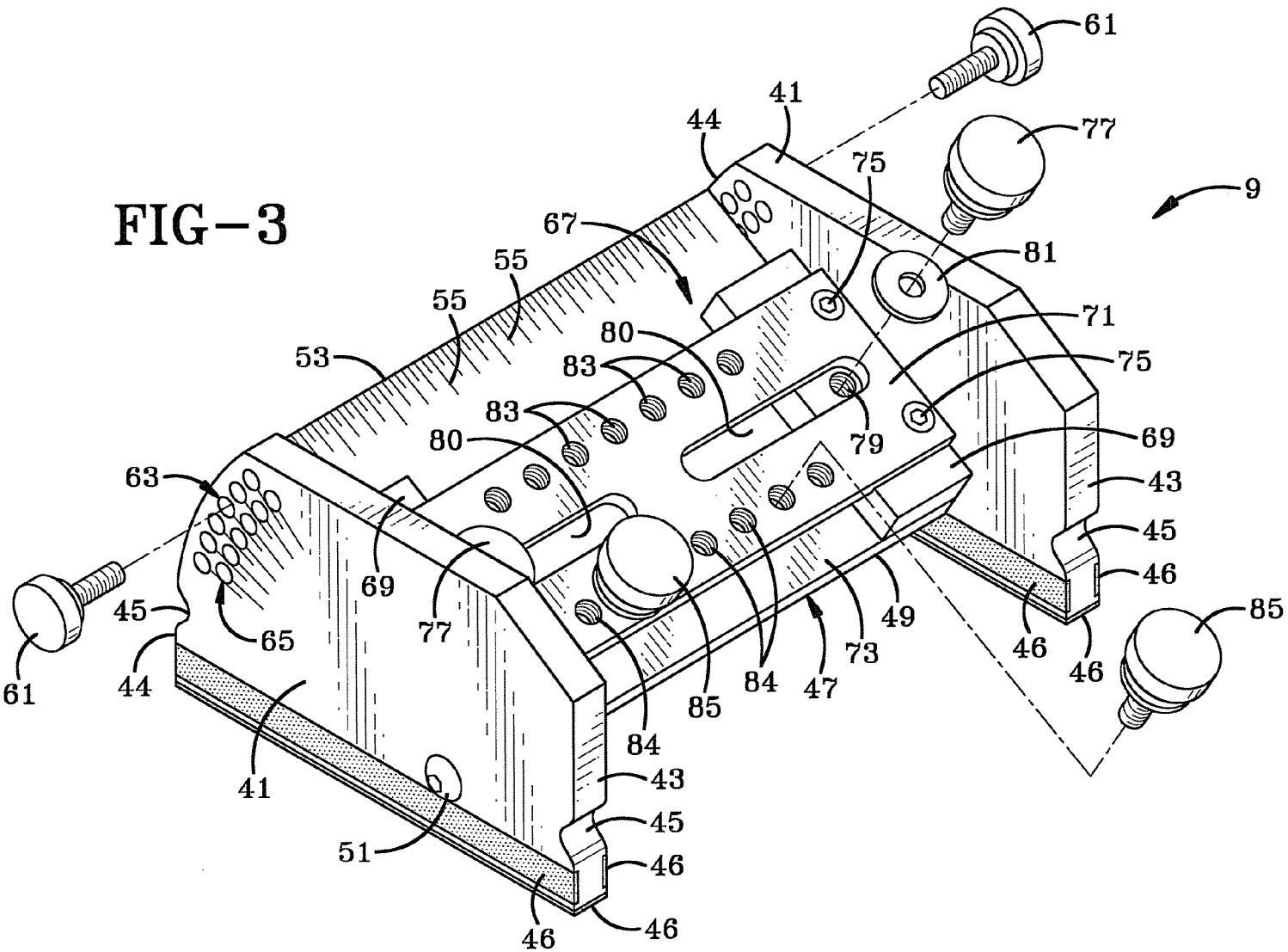
FIG. 3 is an exploded perspective view of the slide carriage component and of the slide carriage clamp mechanism and angle adjustment mechanism of the sharpening apparatus of the present invention.
Figure 15:
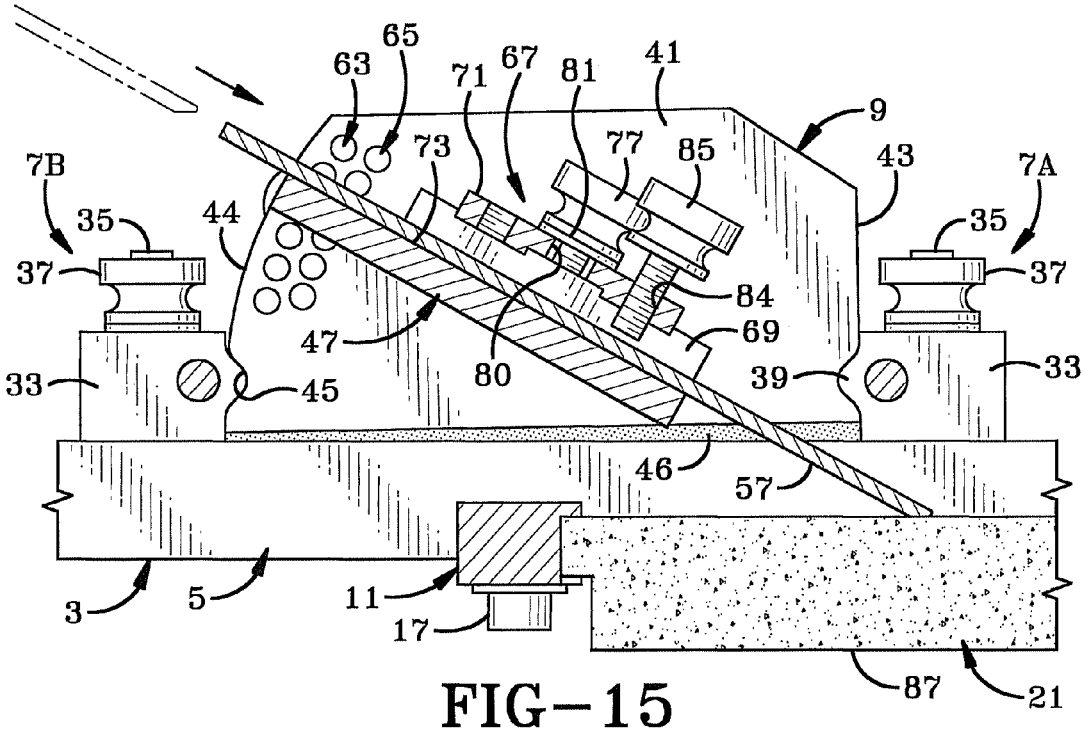
FIG. 15 is an enlarged fragmentary sectional view taken on line 15-15, FIG. 14, with the tool blade being moved into position with the sharpening stone.
Figure 16:
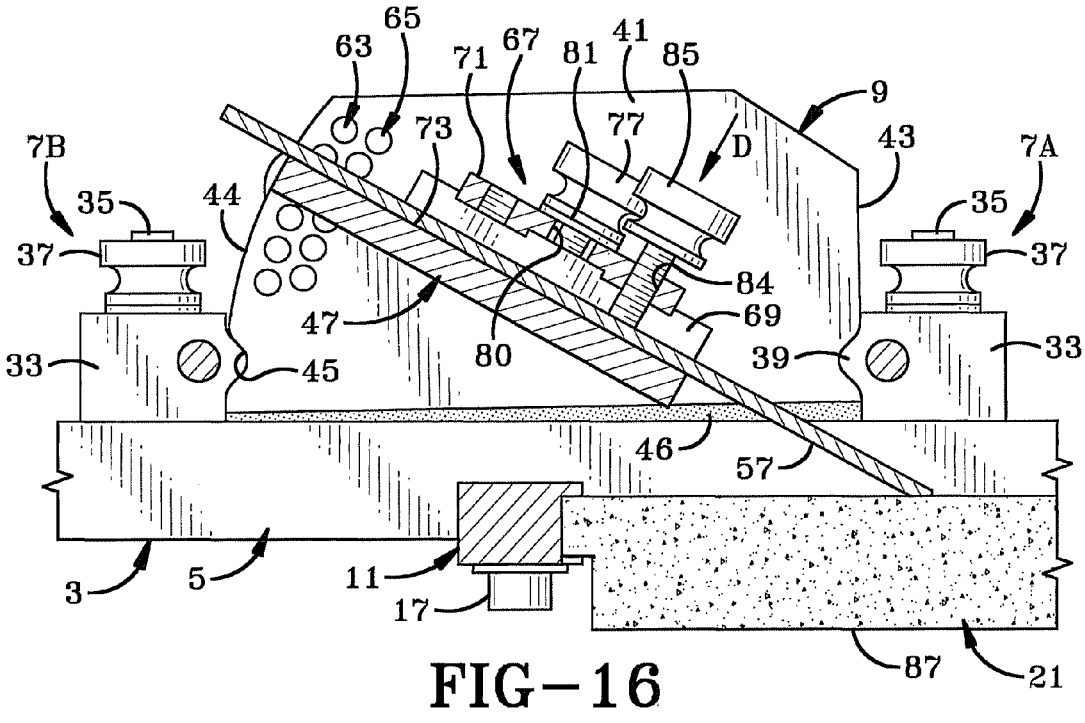
FIG. 16 is a view similar to FIG. 15 showing the tool blade clamped in position on the slide carriage.
Figure 23:
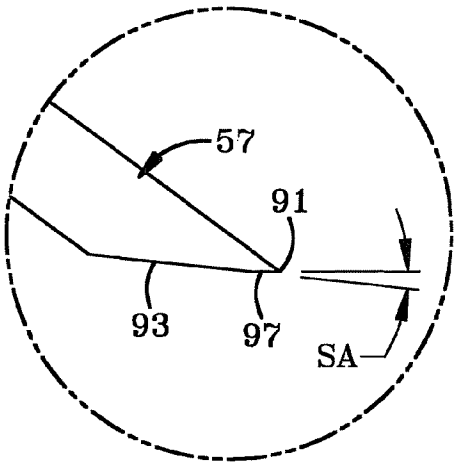
FIG. 23 is an enlarged fragmentary sectional view of the encircled portion of FIG. 22 showing the formation of the secondary angle on the beveled cutting edge of the tool blade.

A threaded hole 59 (FIG. 5) is formed in each of the upper corners of angle plate 47 for receiving a threaded fastener 61 therein for placing angle plate 47 at a desired sharpening angle. Thread fasteners 61 extend through a selected one of a series of arcuate-spaced holes 63 formed in the rear portion of each side plate 41 adjacent edge 44 and into threaded holes 59. A second series of holes 65 are formed inwardly from the first series of holes 63 in side plates 41 and are staggered intermediate pairs of holes 63 as best shown in FIGS. 3, 15 and 16 for positioning angle plate 47 intermediate the two outer holes of the first series of holes 63. The outer series of holes 63 are used in setting angle plate 47 for sharpening the primary angle of a beveled edge of a cutting tool (FIG. 20) with the inner series of holes 65 being used to adjust the angle plate for forming the secondary angled edge of the cutting blade (FIG. 23) as discussed further below.

A clamp mechanism indicated generally at 67 (FIGS. 1 and 3), includes a pair of tool guides 69 which are slidably adjustably mounted on angle plate 47 beneath a guide plate 71 which extends parallel to and is spaced above the top surface 73 of angle plate 47 by offset fasteners 75 which extend through end slots (not shown) formed in the outer edges of guides 69. Tool guides 69 are slidably mounted for movement toward and away from each other in the space between guide plate 71 and angle plate top surface 73 as shown by Arrows A in FIGS. 13 and 14 to adjust the spacing W therebetween. A pair of clamping bolts 77 are threadably engaged in threaded holes 79 formed in each guide plate 69 as shown in FIG. 3, which when screwed tightly against an intervening washer 81 secures guides 69 in an adjusted position for receiving and clamping a tool cutting blade 57 therebetween as shown in FIG. 14. Guide plate 71 is formed with a pair of slots 80 for receiving clamping bolts 77 therethrough and with upper and lower rows of threaded holes indicated at 83 and 84, respectively, for receiving a pair of clamping bolts 85 in a selected pair of holes for engaging and securing cutting blade 57 therein as shown in FIGS. 14-16. Clamping bolts 85 are preferably positioned laterally from each other as shown in FIG. 14 when clamping plane blades or similar cutting blades, and when clamping narrower cutting tools such as chisels, may have one clamping bolt 85 in each of the upper and lower rows of threaded holes 83 and 84 (not shown). This enables wider blades to be secured by a pair of laterally aligned clamping bolts 85 and more narrow blades secured by longitudinally aligned clamping bolts 85 due to the formation of the series of threaded holes 83 and 84.

The operation of apparatus 1 for carrying out the method steps of the present invention is described below. It is readily understood that most sharpening stones 21 will be used wet with water, oil or other lubricants which help to float away metal debris after removal from the blade end to extend the life of the sharpening stone and dramatically improve edge sharpness. It is also understood that apparatus 1 and the method of the subject invention can be used with a sharpening stone 21 containing various types of abrasive grits, or with granite or glass surface plates which use a honing film which differs from sharpening stones primarily in the grit size and amount of metal removed. Coarser grit stones work faster, but do not always leave the sharpest edge wherein honing films are made up of far more refined abrasives and provide an extremely sharp edge.

Figure 9:
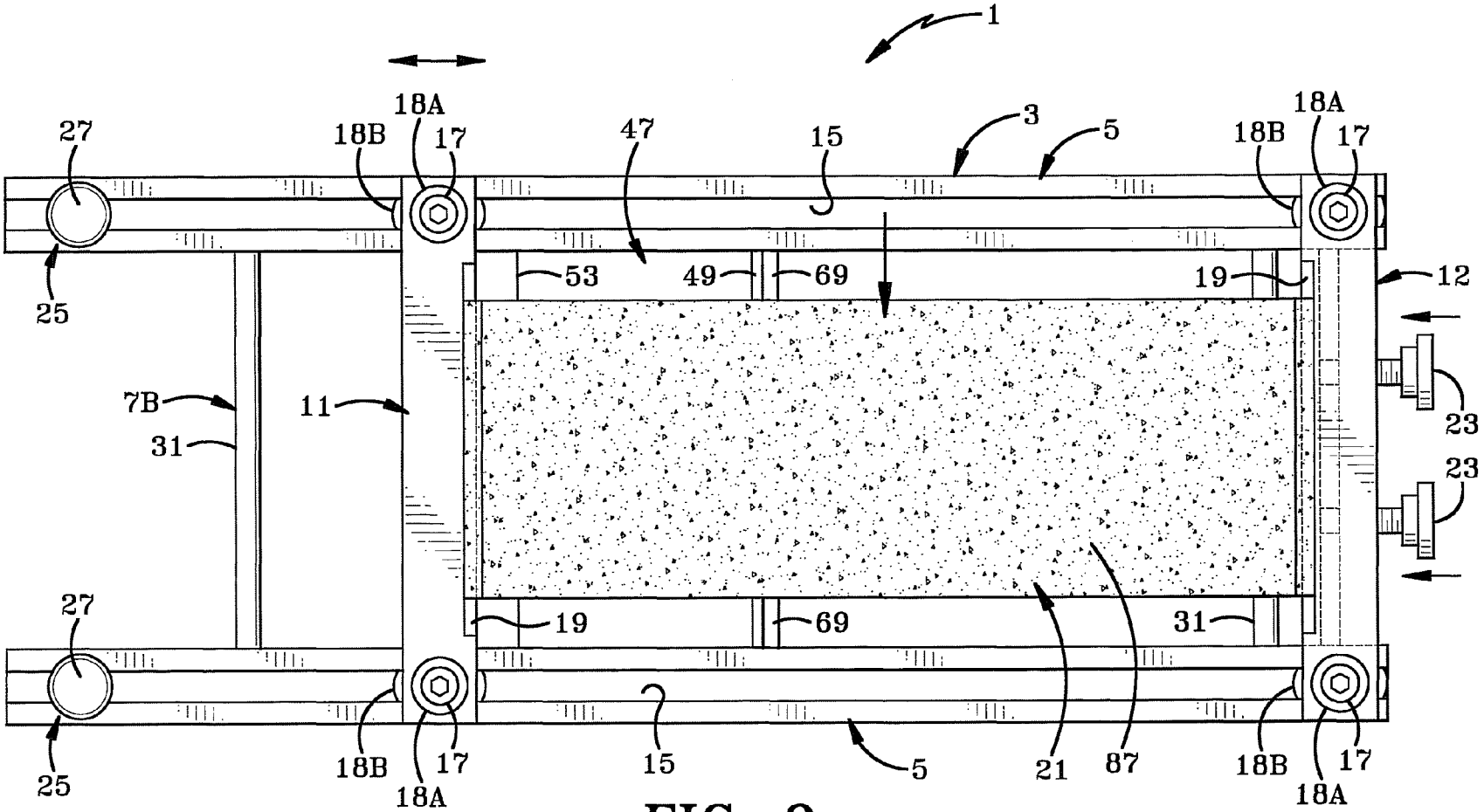
FIG. 9 is a bottom plan view of the slide rails and attachment brackets mounting a sharpening stone thereon.
Figure 10:
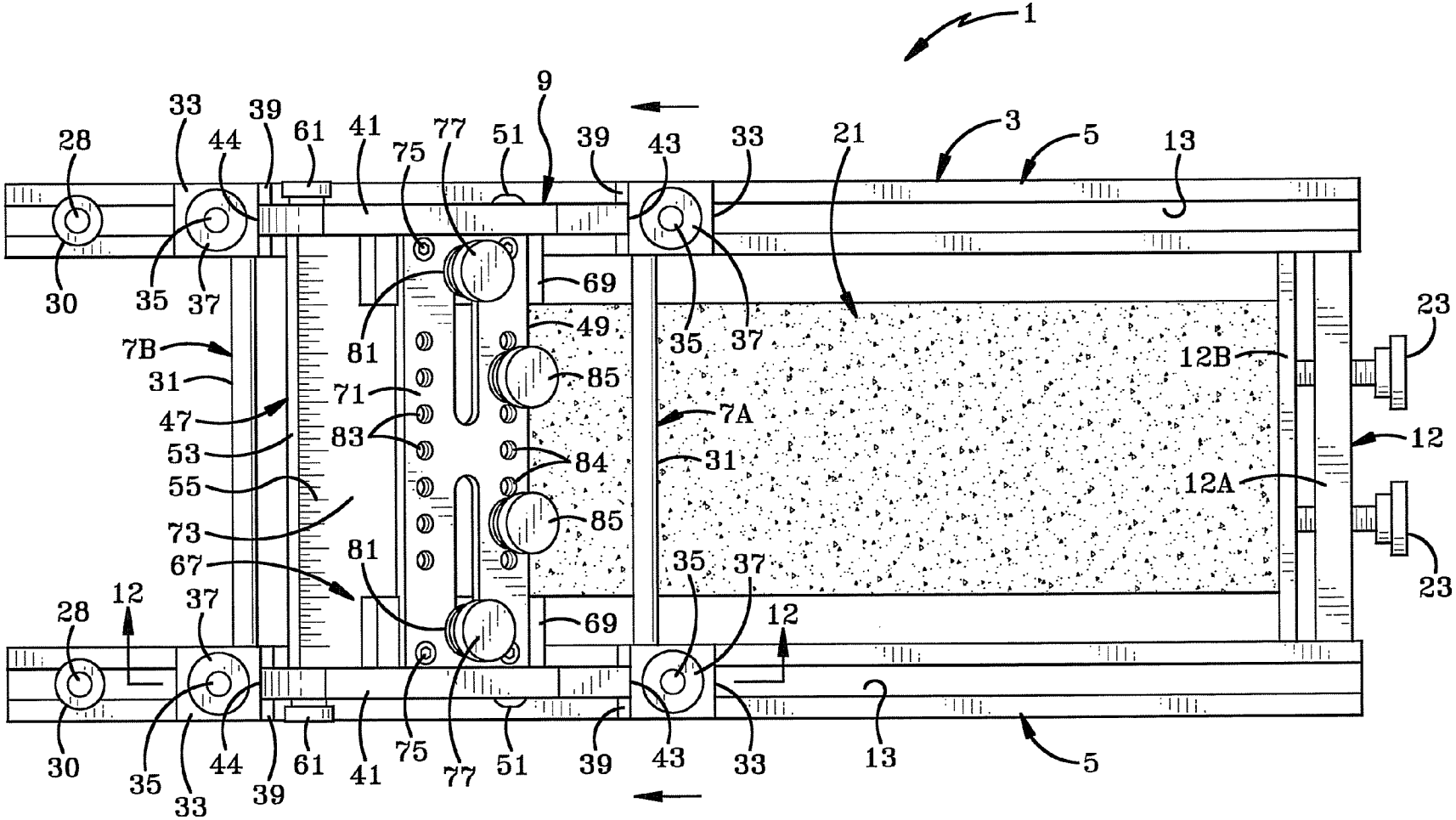
FIG. 10 is a top plan view of the sharpening apparatus with the sharpening stone mounted therein.

When first using apparatus 1, support surface 3 is turned over as shown in FIG. 9 after removing carriage 9 from top slide channels 13. Rear bracket 11 is loosened and stone 21 placed in position as best shown in FIGS. 9 and 11, afterwhich rear bracket 11 is pressed tightly against the stone and tightened in position by tightening screws 17. Thumb screws 23 then can then be tightened to further clamp stone 21 in position between front and rear brackets 11 and 12. Next, the support surface and attached stone 21 are then placed right side up into a position as shown in FIGS. 10 and 11 where the bottom edge 87 of stone 21 rests against a top support surface 89 such as a table top, work bench or the like, and provides the main support for apparatus 1 during the sharpening operation. Adjustment levelers 25 are then adjusted whereby the support foot 27 is just touching and/or preferably positioned just above work surface 89. This slight gap allows the stone to rest firmly on the support surface while the levelers still provide support when necessary.

Figure 5:
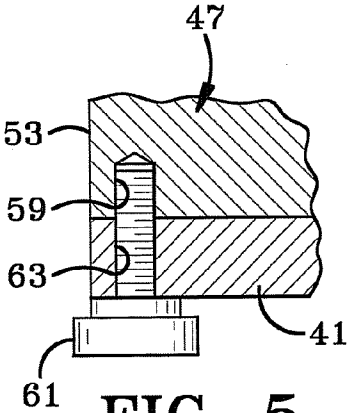
FIG. 5 is an enlarged fragmentary sectional view taken on line 5-5, FIG. 4.
Figure 20:
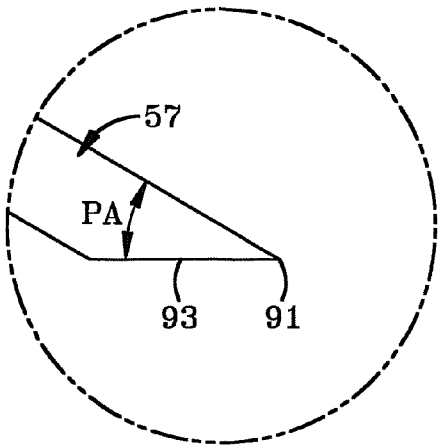
FIG. 20 is an enlarged fragmentary view of the encircled portion of FIG. 20 showing the sharpened primary blade angle.
Figure 22:
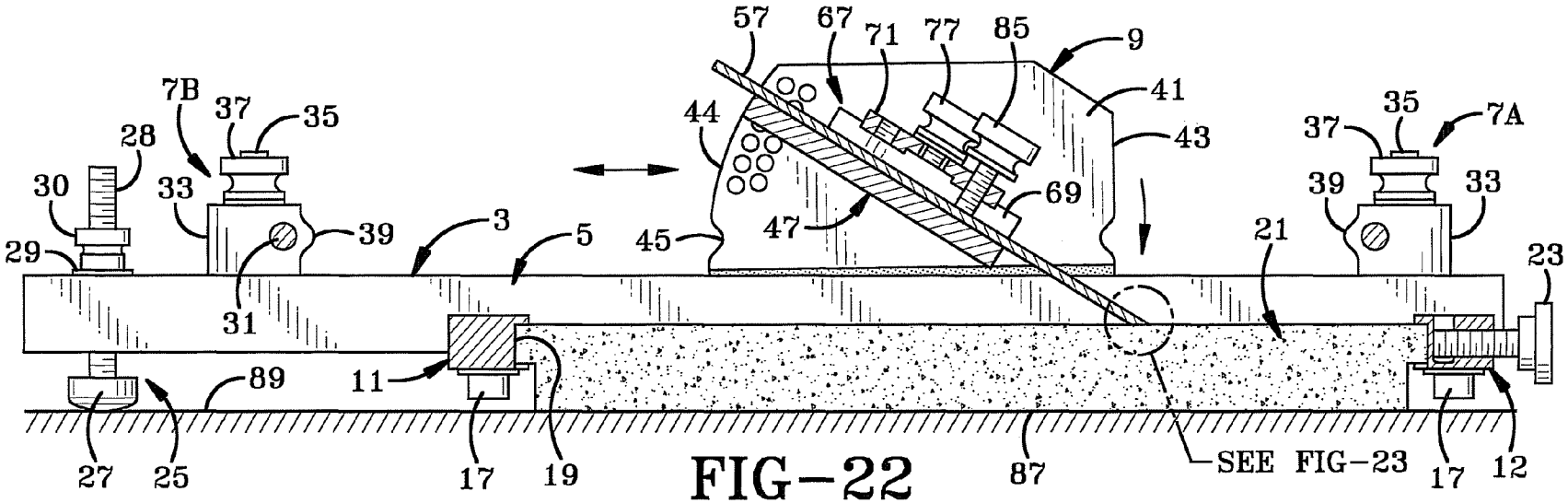
FIG. 22 is a view similar to FIGS. 17-19 showing the secondary angle being formed on the cutting blade.

The next step is to set the desired angle, preferably prior to installing the tool cutting blade. Thumb screws 61 are removed from threaded engagement with angle plate 47 (FIG. 3). This enables angle plate 47 to be pivotally raised and lowered on pivot pins 51 until the appropriate angle hole 63 is in line with threaded hole 59 formed in the edge of angle plate 47 (FIG. 5). The selected hole is the primary angle closest to the existing angle of the tool such as represented by angle PA, which forms the sharpened edge 91 of the beveled edge 93 as shown in FIG. 20. The primary angle (PA) is indicated by printed indicia lines 95, such as shown by angles 15, 20 and 25 indicia in FIG. 21. These primary angles are usually known for a particular cutting tool blade. Fasteners 61 are then tightened securely positioning angle plate 47 at the desired primary angle.

Next, carriage 9 is placed on slide rails 5 by placing the bottom ends of side plates 41 into top slide channels 13 and then slidably positioning the front end of the carriage so that it is approximately centered on the sharpening stone. Then front stop bracket 7A is moved into position as shown in FIG. 10 and secured by tightening nuts 37 as shown in FIG. 11A. Rear stop bracket 7B is then moved forwardly from the position of FIG. 8 to that of FIG. 10 with sufficient force so that lobes 39 of each stop block 33 extend into notches 45 formed in both the front and rear edges of side plates 41 as shown in FIGS. 11 and 11B. This securely traps carriage 9 between the stop brackets and upon movement of lobes 39 into notches 45 will raise the front portion of carriage 9 upwardly as shown by Arrow B in FIG. 11B. This lifting is what sets the amount of material to be removed from the tool edge during sharpening.

Figure 13:
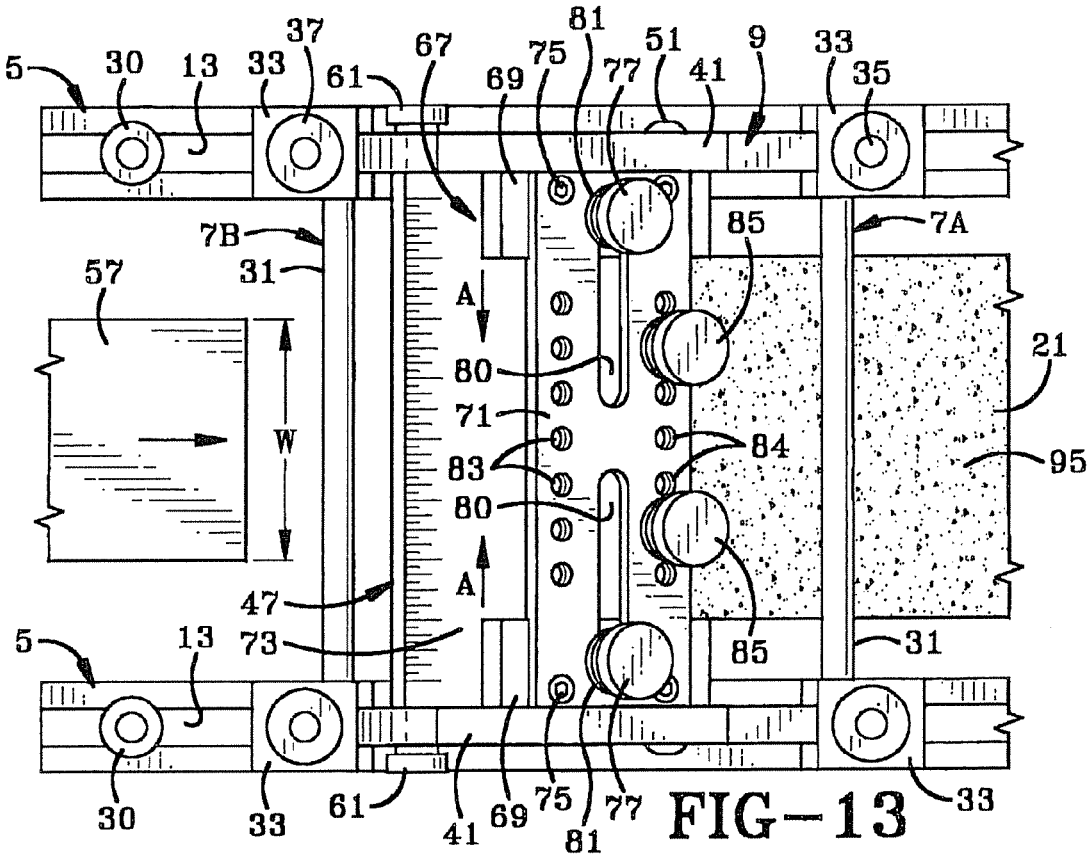
FIG. 13 is a fragmentary top plan view showing the tool blade prior to being secured in the carriage.
Figure 14:
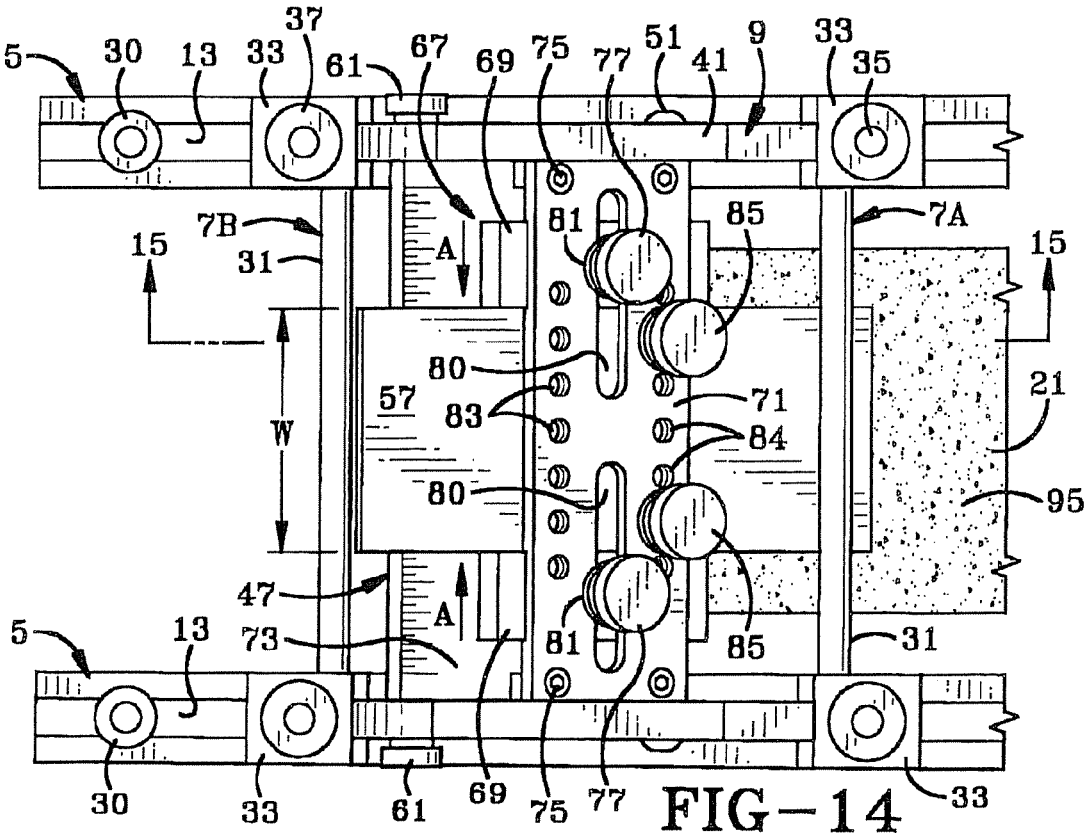
FIG. 14 is a view similar to FIG. 13 showing the tool blade secured in the clamp mechanism.
Figure 17:
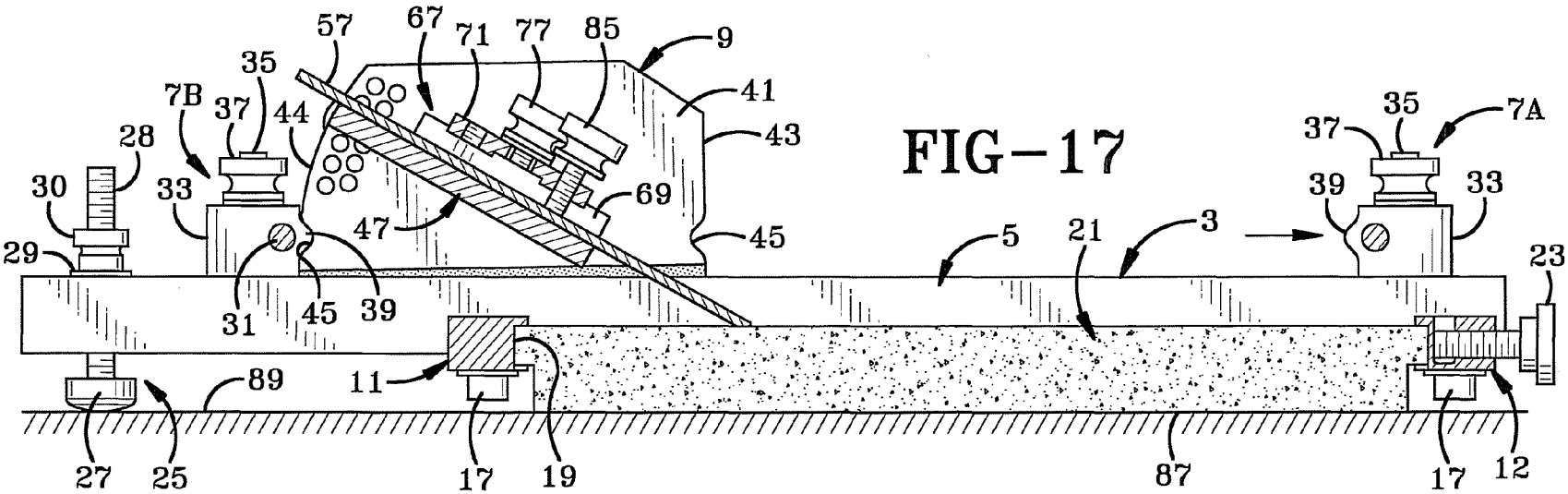
FIG. 17 is a side elevational view showing the tool blade at the start of the sharpening procedure.
Figure 18:
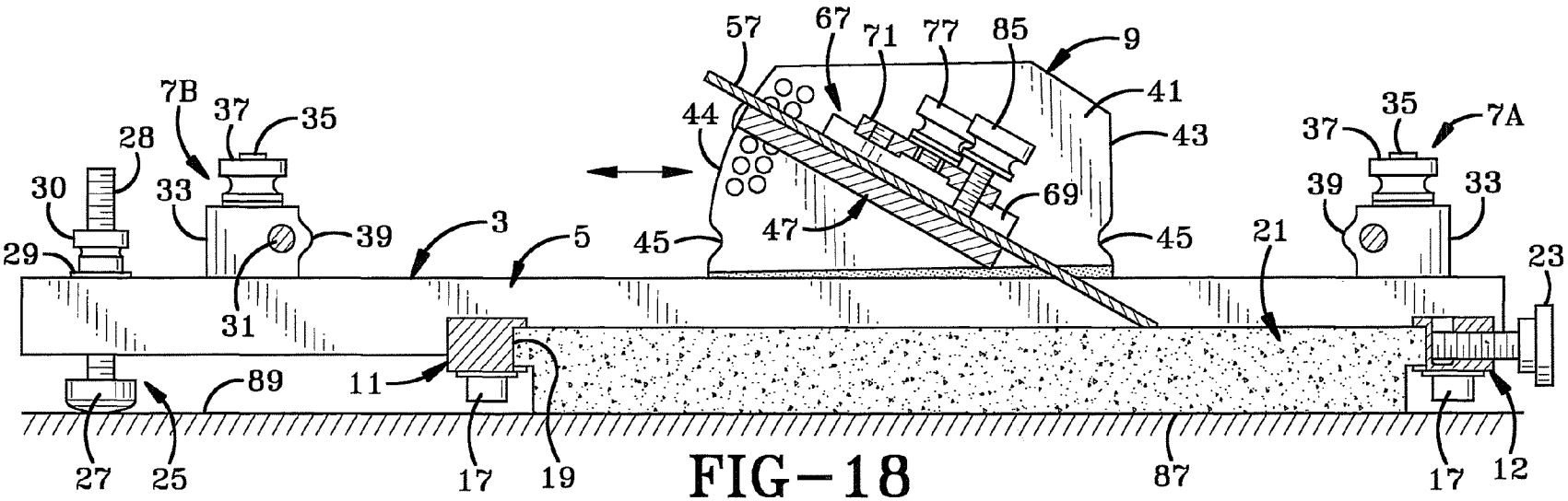
FIG. 18 is a view similar to FIG. 17 showing reciprocal movement of the carriage along the sharpening stone.
Figure 19:
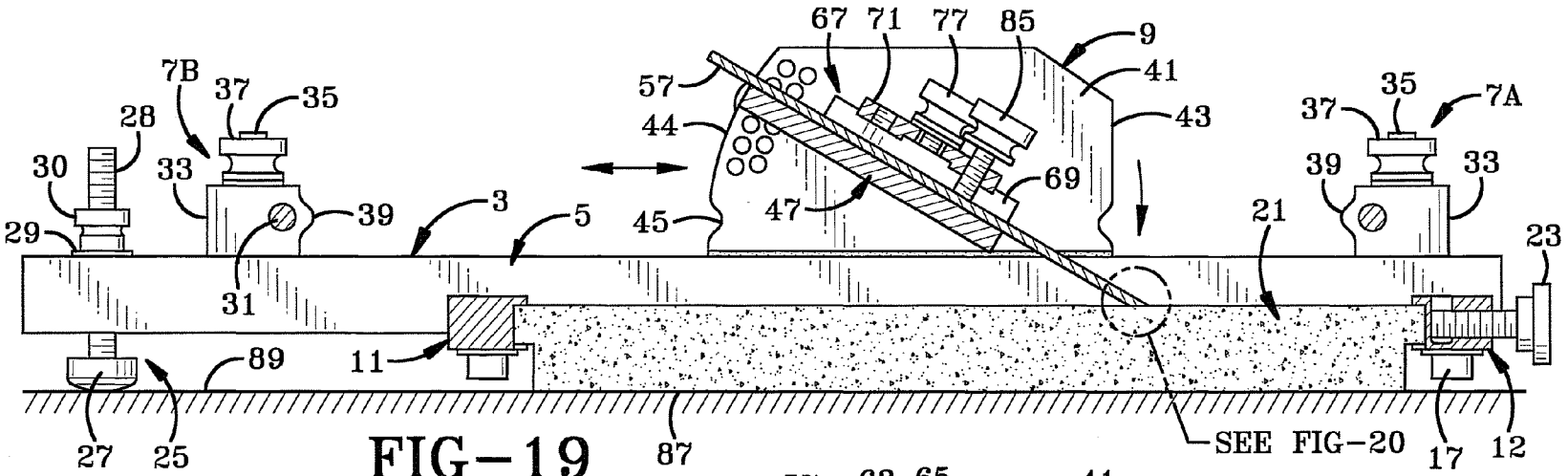
FIG. 19 is a view similar to FIGS. 17 and 18 showing the final movement of the carriage for completing the sharpening of the primary angle of the tool blade on the sharpening blade.

With the carriage locked between the stop brackets, the cutting tool 57 is slid between guides 69 (FIGS. 13 and 14) until beveled edge 93 contacts top surface 95 of sharpening stone 21 as shown in FIGS. 14 and 15, afterwhich both guides 69 are moved inwardly as shown by Arrows A in FIGS. 13 and 14 where they are clamped tightly against the edges of cutting blade 57 and secured therein by tightening of clamping bolts 77. While holding cutting blade 57 against angle plate 47 wherein blade surface 93 just touches stone surface 95, clamping bolts 85 are tightened against cutting blade 57 as shown in FIGS. 15 and 16 securely clamping blade 57 in position on angle plate 47. After cutting blade 57 has been secured in a clamped position on angle plate 47, stop bracket clamp bolts 37 are loosened on the forwardmost stop bracket 7A. Carriage 9 is slid forward until the blade is just short of the end of sharpening stone 21, afterwhich front stop 7A is again secured by tightening of both bolts 37. Bolts 37 of rear bracket 7B are then loosened and carriage 9 is slid back until the blade is just short of the rear bracket as shown in FIG. 17 to set the length of reciprocal movement of the blade along top surface 95 of sharpening stone 21.

Figure 21:
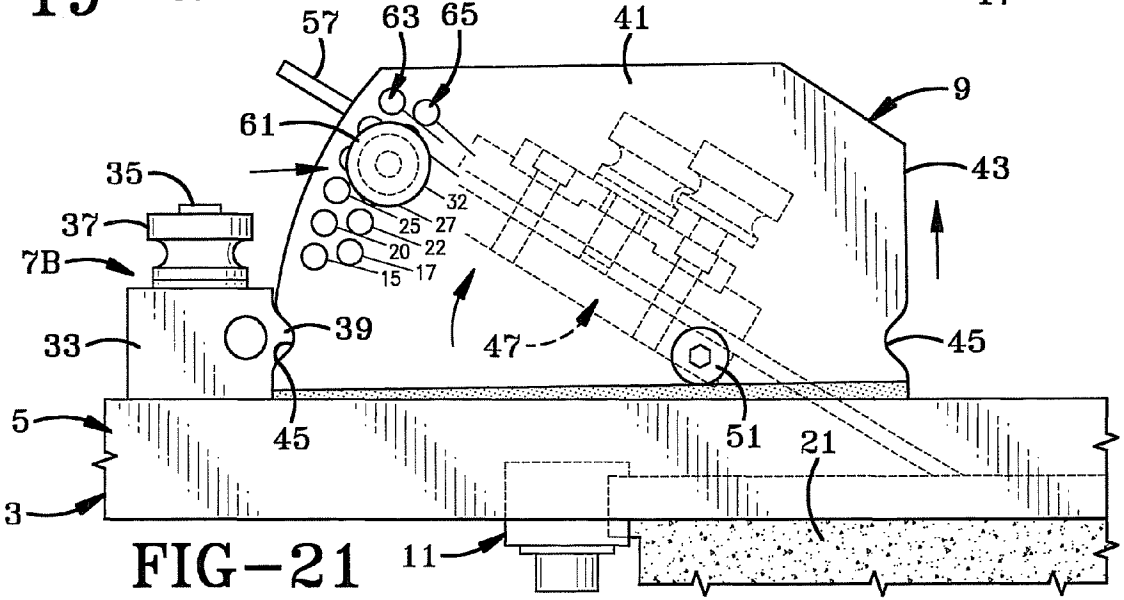
FIG. 21 is a fragmentary sectional view showing readjustment of the angle plate for subsequent forming of the secondary angle on the beveled edge of the tool cutting blade.

A slight downward pressure is applied to carriage 9 while sliding the carriage forwardly. The pressure is then released as the carriage is slid back and this process is repeated while keeping slight pressure on the forward stroke. By doing so, this provides a more flat bevel on surface 93, and hence a sharper edge. After providing the desired sharpness to edge 91 (FIG. 20) by repeated reciprocal sliding movement of carriage 9 along slide rails 5 while providing the desired downward pressure, the correct amount of material is removed from the blade edge which is provided due to the slight upward movement of the forward edge of the carriage by the engagement of lobes 39 in notches 45 as shown in FIGS. 11A and 11B. When a secondary angle SA (FIG. 23) is desired at edge 91, fasteners 61 are released and the angle plate is moved slightly until threaded fasteners 61 extend through a pair of aligned intermediate holes 65 of the second series of holes as shown in FIG. 21. For example, if fasteners 61 extend through an angle hole of 20°, fasteners 61 would then be placed through alternate holes with the indicia angle of 22°. Angle plate 47 would then be secured in this adjusted position by reinserting and tightening threaded fasteners 61. The same reciprocal movement of the blade edge along top surface 95 will then form a slightly flat angled edge 97 (FIG. 23) providing the secondary angle SA. After completion of this operation, bolts 85 are released from their clamping engagement with tool cutting blade 57 enabling it to be removed from apparatus 1.

Thus, apparatus 1 provides for the accurate positioning and sharpening of a tool blade for sharpening and providing the desired primary angle (PA), and if desired, a second angle (SA) with an extremely high degree of accuracy and in a repeated fashion regardless of how many times the blade is sharpened, and which enables various types of cutting stones or honing film to be used and enables even an unskilled woodworker or craftsman to utilize the apparatus to achieve the desired blade sharpening effect. Furthermore, only the needed amount of material is removed from the blade edge when achieving the desired primary angle due to the engagement of stop lobes 39 in side plate notches 45 during setup of the carriage, and which enables the blade to be placed at various lateral positions on the carriage to utilize the entire width of the sharpening stone, thereby avoiding the same area being used for sharpening the blade each time the apparatus is utilized. Furthermore, the length of the longitudinal stroke can be varied depending upon the setting of the front and rear stops again enabling the entire sharpening surface of the abrasive grit to be utilized.

Furthermore, if desired, a honing film can be mounted by various attachments replacing stone 21, enabling the apparatus to be used either with a stone 21 having various abrasive grits in the sharpening surface or used with various honing films without affecting the manner of use of apparatus 1. Thus, apparatus 1 provides an extremely simple inexpensive yet rugged and durable device which provides accurate sharpening of various tool blades with various types of sharpening abrasives both by skilled and unskilled craftsmen.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus for sharpening a tool blade comprising:

a pair of guide rails;

brackets for mounting a sharpening stone between the guide rails;

a carriage movably mounted on the guide rails;

a pair of stops limiting movement of the carriage along the guide rails;

said carriage including a pair of spaced side plates and an angle plate extending between said side plates;

a clamp mechanism mounted on the angle plate for holding the tool blade in contact with the sharpening stone as the carriage moves along the guide rails; and an angle adjustment mechanism for setting the angle of the angle plate and correspondingly the angle of the tool blade with respect to the sharpening stone whereupon linear movement of the carriage along the guide rails moves the blade along the sharpening stone;

wherein the angle adjustment mechanism includes a first series of holes extending in an arcuate manner in each of the carriage side plates; and in which fasteners extend through a selected pair of said holes and into engagement with the angle plate.

2. An apparatus for sharpening a tool blade comprising:

a pair of guide rails, each of the guide rails having top and bottom grooves;

brackets for mounting a sharpening stone between the guide rails, wherein at least one of the sharpening stone mounting brackets includes a pair of end clamps slidably mounting said one mounting bracket in the bottom groove of the guide rails for securing the sharpening stone in said mounting brackets;

a carriage movably mounted on the guide rails, said carriage including a pair of spaced side plates slidably mounted in the top grooves of the guide rails, and an angle plate extending between said side plates;

a pair of stops limiting movement of the carriage along the guide rails;

a clamp mechanism mounted on the angle plate for holding the tool blade in contact with the sharpening stone as the carriage moves along the guide rails; and an angle adjustment mechanism for setting the angle of the angle plate and correspondingly the angle of the tool blade with respect to the sharpening stone whereupon linear movement of the carriage along the guide rails moves the blade along the sharpening stone.

3. The apparatus defined in claim 1 wherein a second series of holes is formed in each of the carriage side plates and are aligned intermediate with the first series of holes.

4. The apparatus defined in claim 1 wherein indicia is on at least one of the carriage side plates providing the angular position of the angle plate corresponding to each of the holes.

5. The apparatus defined in claim 1 wherein each of the guide rails have top and bottom grooves; in which the carriage side plates are slidably mounted in the top grooves; in which at least one of the sharpening stone mounting brackets includes a clamp for securing the sharpening stone in said spaced mounting brackets.

6. An apparatus for sharpening a tool blade comprising:

a pair of guide rails;

brackets for mounting a sharpening stone between the guide rails;

a carriage movably mounted on the guide rails;

a pair of stops limiting movement of the carriage along the guide rails;

said carriage including a pair of spaced side plates and an angle plate extending between said side plates, said angle plate having a front end and a rear end, said front end being pivotally mounted to the carriage side plates and said rear end being adjustably mounted on the side plates;

a clamp mechanism mounted on the angle plate for holding the tool blade in contact with the sharpening stone as the carriage moves along the guide rails; and an angle adjustment mechanism for setting the angle of the angle plate and correspondingly the angle of the tool blade with respect to the sharpening stone whereupon linear movement of the carriage along the guide rails moves the blade along the sharpening stone.

7. The apparatus defined in claim 1 wherein the angle plate has a front end and a rear end; in which said front end is pivotally mounted to the carriage side plates; and in which the rear end is adjustably mounted to the side plates.

8. The apparatus defined in claim 1 including a pair of adjustment levelers at least at one end of the guide rails.

9. The apparatus defined in claim 1 wherein the side plates have end edges, each formed with a notch; and in which the stops are formed with outwardly projecting lobes which extend into the side plate notches to slightly raise one end of the carriage.

10. The apparatus defined in claim 1 wherein the tool blade clamp mechanism includes a pair of spaced tool guides adjustably mounted on the angle plate for adjusting a space between said tool guides to accommodate tool blades of various widths.

11. The apparatus defined in claim 10 wherein a guide plate is mounted on the angle plate in a spaced relationship therefrom; and in which the tool guides are slidably mounted for movement towards and away from each other in a space between the guide plate and angle plate.

12. The apparatus defined in claim 11 wherein a plurality of holes are formed in the guide plate for receiving at least one clamping bolt engageable with at least one of the tool guides for clamping said one tool guide in a fixed adjusted position on the angle plate.

13. The apparatus defined in claim 11 wherein the clamp mechanism includes a plurality of holes formed in the guide plate and at least one clamping bolt extending through one of said plurality of holes for clamping engagement with the tool blade.

14. The apparatus defined in claim 13 wherein said plurality of holes of the clamp mechanism includes two series of holes extending laterally along the guide plate and spaced longitudinally from each other.

15. An apparatus for sharpening a tool blade comprising:

a support structure;

a bracket for mounting a sharpening member on the support structure;

a carriage movably mounted on the support structure;

a stop limiting movement of the carriage along the support structure;

said carriage including a tool blade holder having a pair of side plates, an angle plate for holding the tool blade in contact with the sharpening member, and a pair of spaced tool guides adjustably mounted on the angle plate for receiving the tool blade therebetween and a plurality of clamp bolts for securing the tool blade between the spaced tool guides; and an angle adjustment mechanism for setting the angle of the tool blade with respect to the sharpening member whereupon linear movement of the carriage along the support structure moves the blade along the sharpening member, said angle adjustment mechanism including a pivot for pivotally mounting a lower end of the angle plate on the side plates and a clamp mechanism for clamping an upper free end of the angle plate in a fixed position to the side plates.

16. A method of sharpening a cutting edge of a tool blade wherein the cutting edge is beveled at a primary angle, said method comprising the steps of:

securing a sharpening stone in a support structure, said stone having a substantially planar abrasive surface;

mounting the tool blade to be sharpened in a slide mechanism moveably mounted for sliding movement along the support structure;

adjusting the angle of the tool blade in the slide mechanism to an angle approximate the primary angle of the cutting edge;

clamping the tool blade at the adjusted angle in the slide mechanism;

sliding the slide mechanism along the support structure to move and press the beveled edge of the tool blade into contact with the stationary abrasive surface; and readjusting the angle of the tool blade in the slide mechanism for forming a secondary angle on the cutting edge.

17. The method defined in claim 16 including the step of raising a front portion of the slide mechanism to set the amount of material to be removed from the tool blade by moving a projection formed on the support structure into a recess formed on the slide mechanism.

18. An apparatus for sharpening a tool blade comprising:

a pair of guide rails;

brackets for mounting a sharpening stone between the guide rails;

a carriage movably mounted on the guide rails, said carriage including a pair of spaced side plates and an angle plate extending between said side plates, said side plates having end edges with each of said end edges being formed with a notch;

a pair of stops limiting movement of the carriage along the guide rails, said stops being formed with outwardly projecting lobes which extend into the side plate notches to slightly raise one end of the carriage;

a clamp mechanism mounted on the angle plate for holding the tool blade in contact with the sharpening stone as the carriage moves along the guide rails; and an angle adjustment mechanism for setting the angle of the angle plate and correspondingly the angle of the tool blade with respect to the sharpening stone whereupon linear movement of the carriage along the guide rails moves the blade along the sharpening stone.

* * * * *